United States Patent [19]

Andersson

[11] Patent Number: 4,805,324

[45] Date of Patent: Feb. 21, 1989

[54] LIGHT SIGN

[76] Inventor: Lorentz Andersson, 2 Guldringen 32, 421 52 Västra Frölunda, Sweden

[21] Appl. No.: 933,346

[22] Filed: Nov. 19, 1986

Related U.S. Application Data

[63] Continuation of Ser. No. 694,454, filed as PCT SE84/00162 on Apr. 30, 1984 published as WO84/04416 on Nov. 8, 1984, abandoned.

[30] Foreign Application Priority Data

May 4, 1983 [SE] Sweden ..... 8302544

[51] Int. Cl.[4] ..... G09F 13/00

[52] U.S. Cl. ..... 40/541; 40/575; 40/592

[58] Field of Search ..... 40/545, 564, 572, 573, 40/575, 591, 592, 606, 553, 581, 558; 362/223, 224, 806, 812, 260, 217, 97, 98, 147, 307, 184, 311, 367, 362, 225

[56] References Cited

U.S. PATENT DOCUMENTS

| | | | |
|---|---|---|---|
| 1,086,960 | 2/1914 | Waterman | 40/564 |
| 1,769,243 | 7/1930 | Tout | 40/564 |
| 1,858,755 | 5/1932 | Van Wyck et al. | 40/564 |
| 1,900,467 | 3/1933 | Scruggs | 362/225 |
| 1,915,511 | 6/1933 | Banse | 40/572 |
| 1,964,856 | 7/1934 | Murray | 40/564 |
| 2,052,755 | 9/1936 | Duffy | 362/147 |
| 2,080,679 | 5/1937 | Uissing | 40/545 |
| 2,147,959 | 2/1939 | Arbuckle | 40/558 |
| 2,269,675 | 1/1942 | Livingston et al. | 40/545 |
| 2,302,667 | 11/1942 | Duncan | 40/545 |
| 2,617,501 | 11/1952 | Quelle | 40/564 |
| 2,651,866 | 9/1953 | Tuttle | 40/575 |
| 2,753,640 | 7/1956 | McConnell | 40/545 |
| 2,823,475 | 2/1958 | Packard | 40/573 |
| 2,998,667 | 9/1961 | Darnell et al. | 40/564 |
| 3,184,594 | 5/1965 | Siegel | 362/311 |
| 3,194,952 | 7/1965 | Locke | 40/564 |
| 3,300,885 | 1/1967 | Haire | 40/545 |
| 3,386,197 | 6/1968 | Elfstrom | 40/572 |
| 3,402,491 | 9/1968 | Wagner | 40/573 |
| 3,423,865 | 1/1969 | Hardesty et al. | 40/563 |
| 3,593,446 | 7/1971 | Gesner, III | 40/564 |
| 3,660,918 | 5/1972 | Bourseau | 40/575 |
| 3,758,973 | 9/1973 | Miller | 40/573 |
| 3,771,245 | 11/1973 | Mabrey et al. | 40/564 |
| 3,935,654 | 2/1976 | Rubin | 40/563 |
| 3,968,359 | 7/1976 | Shaffer | 362/224 |
| 4,139,957 | 2/1979 | Minogue | 40/572 |
| 4,186,424 | 1/1980 | Fohl | 362/240 |
| 4,303,969 | 1/1981 | Hamilton et al. | 362/367 |
| 4,329,739 | 5/1982 | Loebner | 362/153 |
| 4,383,382 | 5/1983 | Hegarty | 40/575 |

FOREIGN PATENT DOCUMENTS

| | | | |
|---|---|---|---|
| 44798 | 1/1928 | Norway | 40/573 |
| 148405 | 7/1931 | Switzerland | 40/572 |
| 370882 | 10/1929 | United Kingdom | 40/564 |
| 912692 | 12/1962 | United Kingdom | 40/564 |
| 2077973 | 12/1981 | United Kingdom | 40/553 |

*Primary Examiner*—Robert Peshock
*Assistant Examiner*—J. Hakomaki
*Attorney, Agent, or Firm*—Cushman, Darby & Cushman

[57] ABSTRACT

A light sign comprising an illuminant (1) provided with substantially parallel channels (2) for discharge tubes (3), at least one translucent sign panel as a support or holder for sign message and a frame (9) which peripherally defines the light sign. The object of the invention is to form a light sign specially intended to be used in such connections where a re-signing often occurs, e.g. on taxi-cabs and where the sign should be very narrow for having as little air resistance as possible, where re-signing should be done with a few manipulations of the sign and without weakening the frame construction of the sign. The light sign should further by simple means be connectible to attachment of different kinds, so that several light signs can be connected with each other forming a continuous unit, e.g., for providing screen walls for exhibition purposes. These objects have been achieved by the fact that the illuminant (1) comprises at least one channel plate provided with channels open at opposite side edges of the plate and into which said discharge tubes (3) are insertable, and that the frame (9) at at least two opposite sides is provided with guides (16) for receiving a sign panel (5) insertable into these from one end side.

11 Claims, 4 Drawing Sheets

LIGHT SIGN

This is a continuation of application Ser. No. 694,454, filed as PCT SE84/00162 on Apr. 30, 1984, published as WO84/04416 on Nov. 8, 1984, which was abandoned upon the filing hereof.

The present invention refers to a light sign comprising an illuminant provided with substantially parallel channels for discharge tubes, at least one translucent sign panel as a support or holder for the sign message and a frame which peripherally defines the light sign.

THE BACKGROUND OF THE INVENTION

Previously known light signs of the above mentioned kind are provided with an internal, disc-shaped holder to which the discharge tube is fixed by means of clamps. This attachment is work requiring and the handling of the discharge tubes involves damaging risks both for the material and the mounting staff. The transparent panel must be attached with relatively large space to the holder disc in order to be tolerably regularly illuminated by the discharge tube and not to get a striped appearance. In that way the thickness of the sign becomes considerable, and the body of the sign as well as the supporting construction must be performed with a corresponding larger dimensions, which results not only in aesthetic but also in great practical disadvantages.

According to the other known devices (GB-B No. 465,135, U.S. Pat. Nos. 1,961,735, 2,095,291, 2,080,679) the discharge tubes are placed in casted, milled or in other ways made grooves in a two part plate, where the grooves and the discharge tubes have been given the desired configuration, e.g. the shape of one or several letters, which means that the sign picture is determined by the shape of the groove, or where the discharge tube and the groove have been given a meander-shape and the sign picture is located as a separate unit in front of and/or behind the discharge tube. bending the discharge tubes in grooves made in a transparent material or vice versa is a circumstantial and expensive manufacturing method. Besides the tubes need space for thermic expansion at the same time as they should be effectively fixed in the grooves, which also causes complications. Light signs consisting of corrugated, transparent panels are known through U.S. Pat. No. 3,300,885. In the wave trough of the panel an U-formed discharge tube is fitted. Two similar panels are located on each other and are held removably together by a frame, forming a plurality of channels, through which the crests of the waves are located to fit-up against each other.

This type of light sign does not have any possibility of replaceable sign panels and if any operation must be done on the sign e.g. changing of a discharge tube, the whole sign with the frame must be dismounted.

The object of the invention is to provide a light sign especially intended to be used in such connections, where a resigning often occurs, e.g. en taxi-cabs and where the sign should be very narrow for having a as little air resistance as possible, where the resigning should be done with a few maipulations and without weakening the frame construction of the sign. The light sign should further by simple means be connectible to attachments of different kinds, so that several light signs can be joined to each other forming a continuous unit e.g. for providing of screen walls for exhibition purposes. These objects have been achieved by the features given in the claims.

DESCRIPTION OF THE DRAWINGS

In the following embodiments of the invention will be described with reference to the drawings.

DESCRIPTION OF THE EMBODIMENTS

Figure 1:
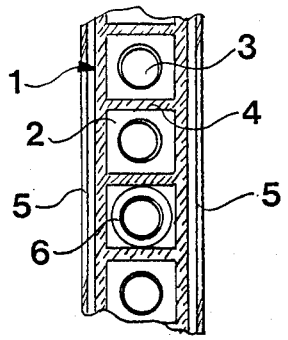
FIG. 1 shows a part section of an illuminant which is a part of the light sign according to the invention.

In FIG. 1 the numeral 1 denotes an illuminant in the form of a holder for discharge tubes 3. The illuminant 1 comprises a plate of a translucent plastic, through which parallel channels 2 pass, having a square cross section and being separated by intermediate walls 4. The channels receive the discharge tube 3 inserted therein. Translucent panels 5 are attached outside the channel plate 1 on both sides with some space from one another, which panels are supports or holders for the text, characters, symbols or picture of the sign. The channel plate 1 and the panels 5 are surrounded and supported by a joint frame 9. If the sign should be one-sided, one panel 5 is replaced by a sealing disc of opaque material.

The conventional fixing of the discharge tubes 3 with clamps is eliminated. The discharge tubes 3 are passed into the channels of the illuminant 1, where they are received with little free space and are kept in position by the walls thereof or by means of packing rings 6, if a guiding or fixing in the channels is necessary. e.g. for counteracting vibrations if the sign is used on a motor vehicle or the like.

For the channel plate 1 a material e.g. acrylic plastic, is used, which provides a good diffusion and a regular distribution of the light from the discharge tubes, so that even when the panel 5 is located close to the plate 1 a regular lightening of the sign is obtained. In order to prevent that the light on the sign panel appears in lighter strakes, the discharge tubes 3 are appropriately provided with maskings facing the sign panel or panels. Said maskings being in the form of narrow (e.g. 3 mm wide) white colour strakes or thin white ribbons are applied against the tube. Requisite electrical attachments and connections for discharge tubes can be arranged to the edges of the channel plate 1, for which purpose the channel plate has been provided with milled grooves, in which electrical attachments and coupling devices are located. These are sealed with a sealing compound so that a waterproof illuminant is obtained.

Figure 3:
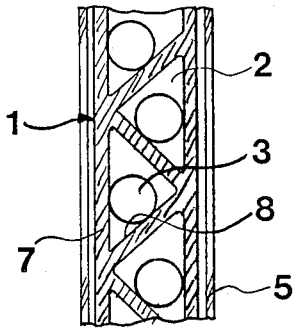
Figure 2:
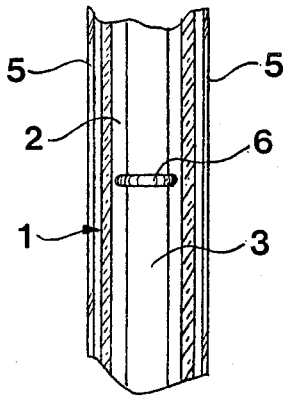
FIG. 2 shows a section according to a plane perpendicular to FIG. 1, FIGS. 3, 4 and 5 show part sections, corresponding to FIG. 1 of three other embodiments.

The embodiment shown in FIG. 3 has a channel plate, the channels 2 of which are performed with a triangular or trapezodial cross section, so that with upright location of the sign, the neon tubes 3 by their weight and by wedge action are held between the inside 7 of the outer walls and the surfaces 8 of the intermediate walls.

Figure 4:
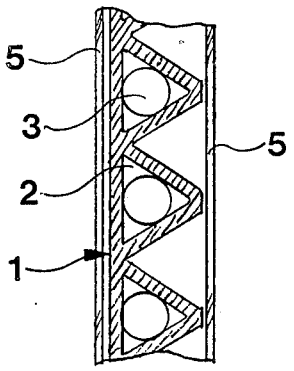

FIG. 4 shows a section of a light sign with similar design, where however the channel plate receiving the discharge tubes only has one plane lateral surface, which makes the sign less material requiring and lighter.

Figure 5:
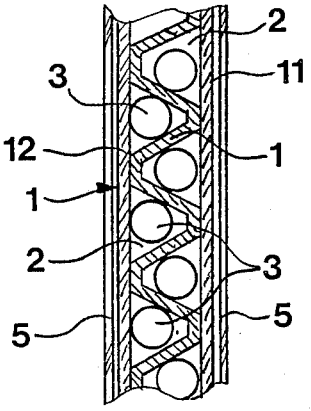

FIG. 5 shows an embodiment similar to the one according to FIG. 3, at which the channel plate has a corrugated core 10, which is surrounded by two sealing disks 11 resp. 12. These parts together correspond to the plate 1 shown in FIGS. 1 and 3.

Figure 6:
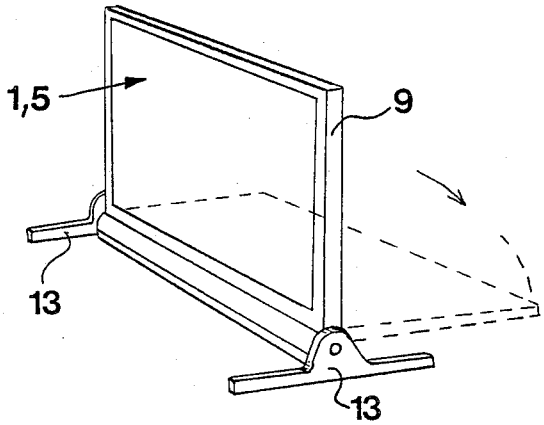
FIG. 6 shows in perspective a light sign according to the invention in assembled condition.

FIG. 6 illustrates the embodiment of a sign according the to invention, provided with a frame 13, by which the sign is rotateably suspended, so that it can be lowered to a horizontal position, which facilitates mounting- and service operations.

For obtaining a good light spreading it is suitable to provide the sign panel 5 resp. the panels onthe side facing the illuminant 1 with a reflecting, luminous coating. In practice the procedure is as follows: On the inner of the sign panel, on the side facing the illuminant 1 the sign message is applied for example by screen printing, whereafter a white transparent and reflecting colour coating is applied over the screen printing.

Instead of being a support of the sign message, the sign panel can also be designed as a holder, and in this case consists of two transparent disks, a bright glass and an opaque between which the sign message printed on white paper or the like is located.

Figure 7:
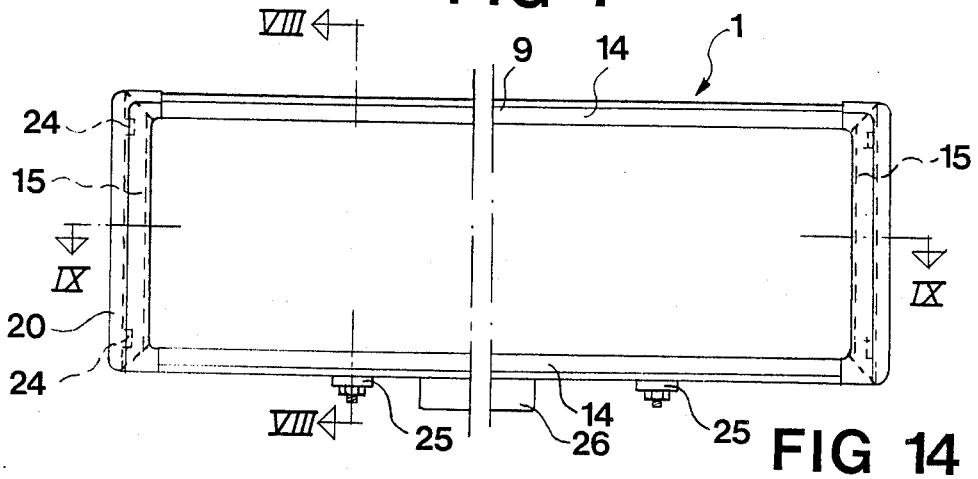
FIG. 7 shows a design of the light sign in a front view.
Figure 8:
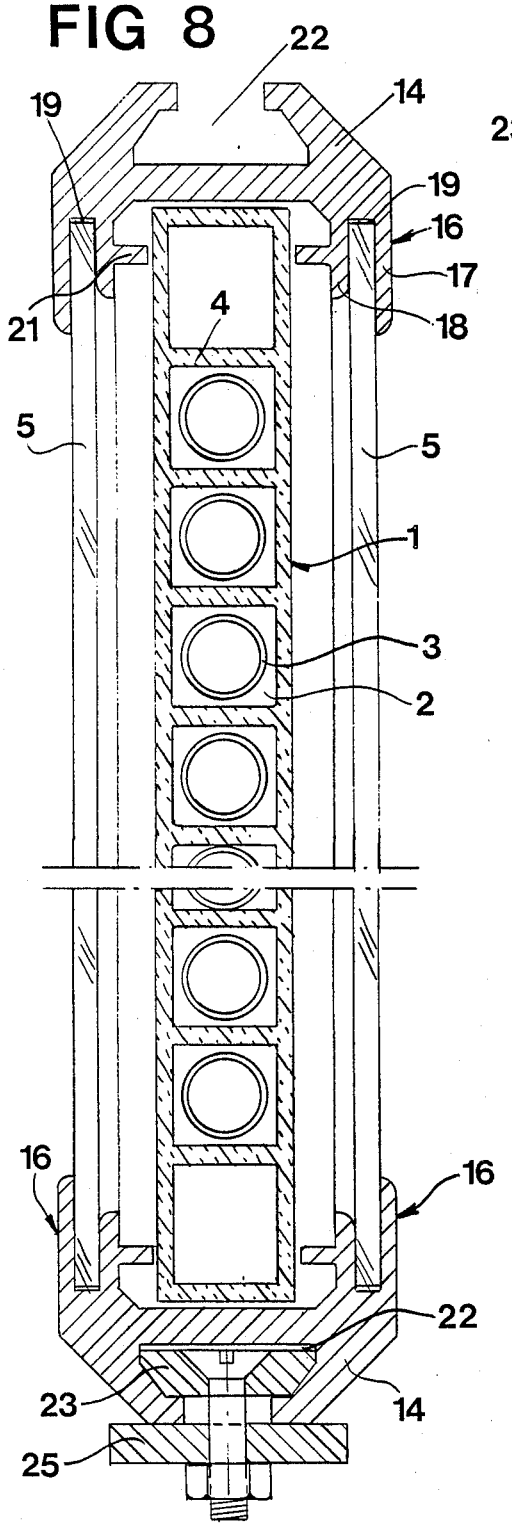
FIG. 8 is a section according to the line VIII—VIII in FIG. 7.
Figure 9:
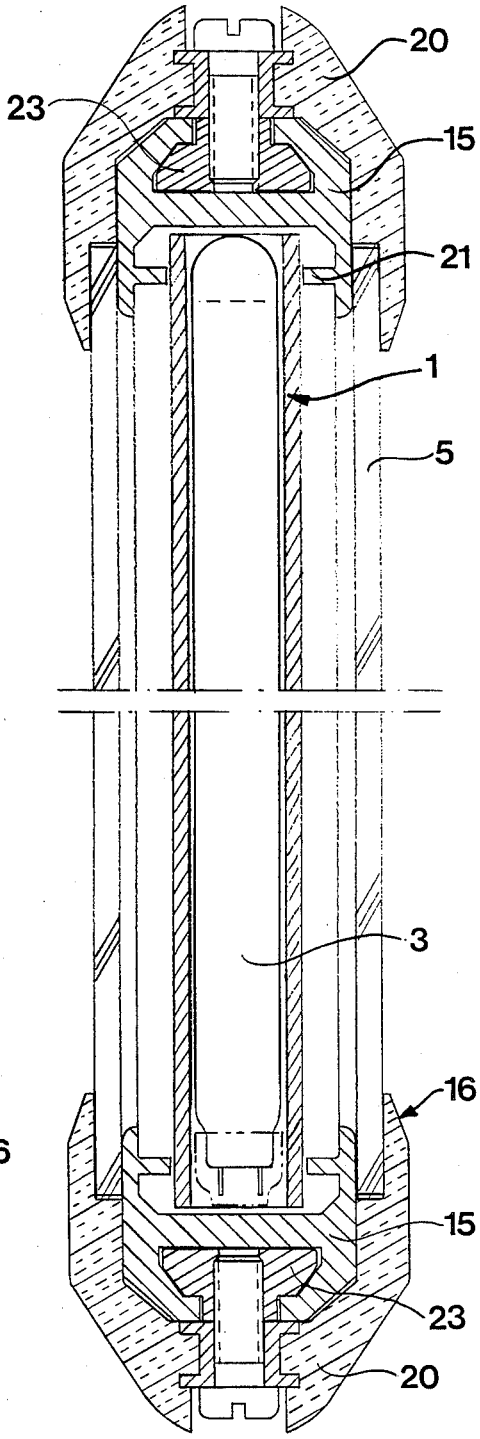
FIG. 9 is a section according to the line IX—IX in FIG. 7.

The light sign according to the invention is so built up, that the sign panel 5 or the panels with simple manipulations can be exchanged without that the whole frame 9 or even the illuminant 1 fall apart. For this purpose the frame 9 is at least at two opposite sides, in the embodiment shown in FIGS. 7–9, the long sides 14 of the sign, composed by a profiled bar while the short side of the sign 15 are made of another profiled bar. The profiles which form the long sides 14 of the sign are provided with longitudinal guides 16, which are made of two flanges 17 and 18, between which there is a groove 19 for receiving a sign panel 5. The profile which forms the short sides 15 of the light sign lacks the groove 19 and the flange 17, which parts on the other hand are formed in an end termination profile 20, which can be passed over the resp. short side 15, through which the sign panel 5 along all side edges is surrounded by the frame 9.

The profiles of the long sides as well as the short sides 14 and 15 are on their one internal side provided with a short distance members 21 for spacing and fixing the illuminant 1. At the side of the profiles 14,15 facing away from the illuminant there is arranged a longitudinal grooves 22 designed as a support for different connection members. Such a connection member can be a nut washer 23, insertable through recesses 24 arranged in the profile, and which nut washers are used for screwing the end terminations 20 firmly. The longitudinal grooves 22 can also be used for fastening the fitting 25 which supports the light sign. To the groove 22 there can also be connected an apparatus cap 26 containing the electric respective electronic components which are required for starting and running the discharge tubes.

The profiles 14 and 15 of the frame 9 are connected with each other preferably in such a way that one short side 15 is welded to the long sides 14, while the opposite short side 15 is connected by means of nipples. In this way the illuminant 1 can be drawn out of the frame anytime, which however demands a somewhat greater manual effort than if the sign panels 5 are to be changed, which occurs by the fact that one of the end terminations 20 is released whereafter the grooves 19 of the guides 16 are accesible, so that changing of sign panels can take place. If the light sign according to the invention should be used as an advertisement sign on motor vehicles, e.g. on taxi-cabs, the end terminations 20 are manufactured of a slightly flexible plastic material.

Figure 10:
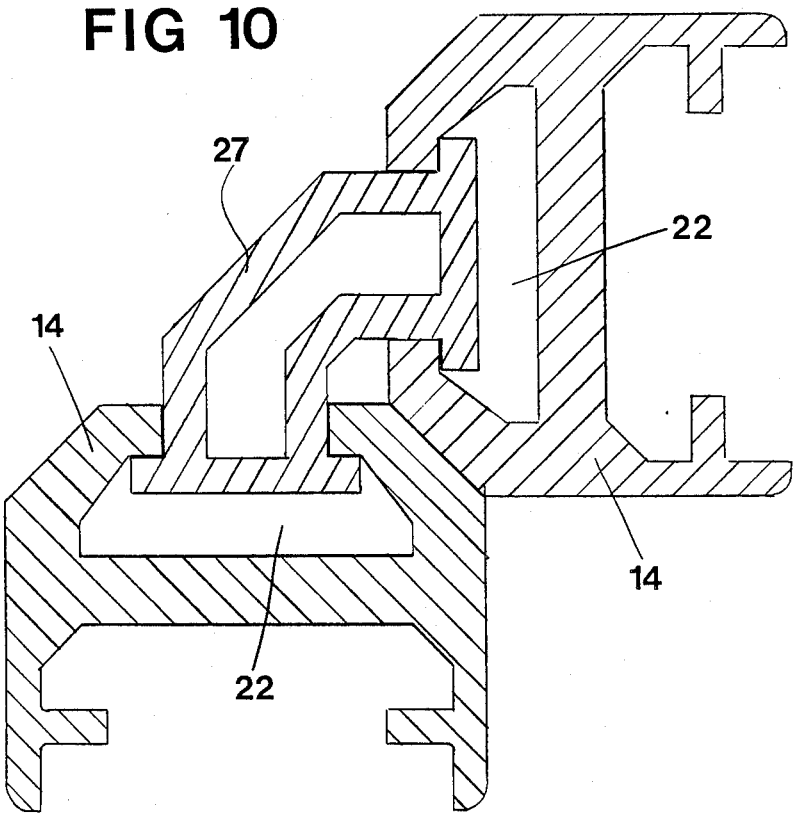
FIG. 10 shows a section through the end portions of the mutually connected light signs forming a corner.
Figure 11:
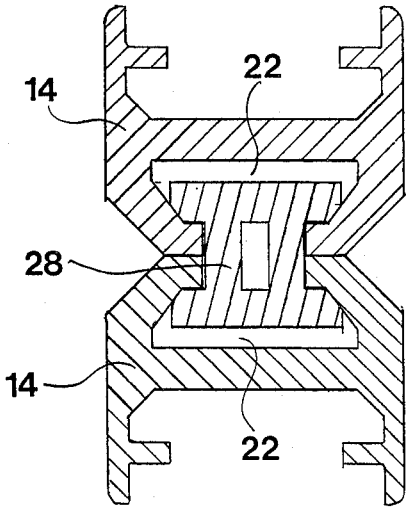
FIG. 11 is an analogue section with FIG. 10 of two in the extension of one other connected light signs.

The light sign can also possibly in a somewhat modified design be used as an advertisement support at exhibitions, for which purpose two or several signs are connected, so that even space defining units can be provided. This can be done by means of special connection members 27 resp. 28 in the form of special profile bars which partly can connect two light signs perpendicularly to each other as is shown in FIG. 10 and for which purpose the profile 14, 15 on the both sides of the groove 22 is chamferred preferably at 45°, and besides the connection by means of the connection members 28 can be made, so that the light signs are located in the extension of each other, as is shown in FIG. 11.

Figure 12:
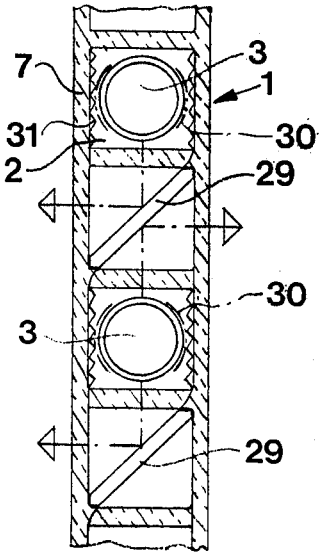
FIGS. 12 and 13 show further part sections through modified illuminants according the invention.

In order to prevent the occurance of light strips after the discharge tubes 3 in the illuminant 1 to an even greater extent, it might be suitable, as is shown in FIG. 12, to place the discharge tube 3 in every other channel 2 and in the intermediate channels place a reflector 29, which in the embodiment shown in FIG. 12 consists of a belt shaped disk with double-sided reflectors, in order that the discharge tubes 3 on both sides of the reflector reflect in different directions.

In order to further intensify the light equalization the discharge tubes 3 can either be provided with the previous mentioned maskings 30 in the form of white colour strakes or thin strips or the outer channels side walls 7 of the illuminant can also preferably on the inside be provided with grooves 31.

Figure 13:
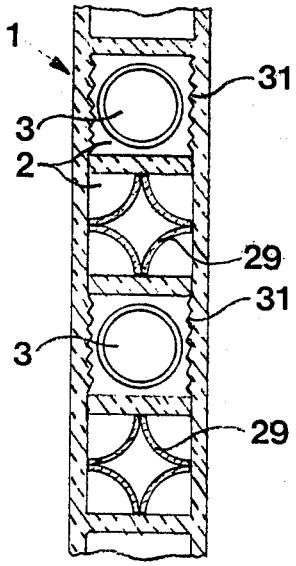

Instead of plane border-shaped disks, the reflectors 29 can consist of prism-like, appropriately extruded profiles, as is shown in FIG. 13, which are fixed in such a way in every other channels 2 in the illuminant 1, that the tips of the profile is directed towards the inner walls of the channel.

Figure 14:
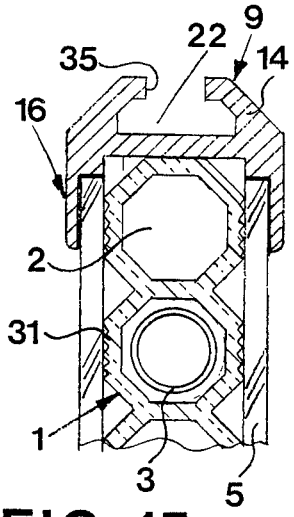
FIGS. 14 and 15 show an analogue section with FIG. 8 and 9 through a simplified embodiment.
Figure 15:
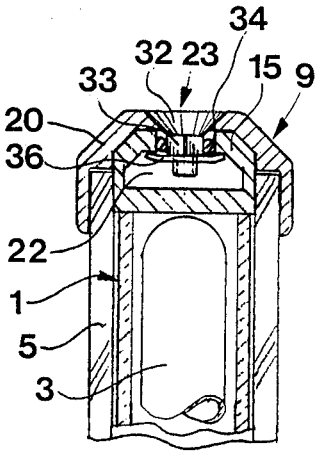

As the illuminant 1 is designed with respective provided with light spreding means according to what is shown in FIG. 12 and 13, the light sign can be designed even more compact, so that the sign panel 5 can practically fit-up against the illuminant 1. This is shown in the embodiment according the FIGS. 14 and 15, where the channel plate of the illuminant 1 has the cross section shape shown in FIG. 14 and where every individual channel has the shape of an octahedron. The side portions of every octahedron which also forms the side limitings of the channel plate is provided with longitudinal grooves 31, which also form contact surfaces against the sign panel 5. By this design the profile bars 14 and 15 of the frame can also be designed more simply and more narrow as the distance members between the illuminant and the sign panel 5 are eliminated. The attachemnt of the detachable end terminations 20 is made by means of simple connection member 23 consisting of a screw 32 provided by a non-round portion 33, in cross section for example square and about which an O-ring 34 is fitted.

The whole unit is so determined that a rotating of the screw 32 causes a clamping of the square portion 33 against the side edges of the longitudinal groove 22, within the area for the mouth of the groove 22. For preventing that the screw 22 is drawn out of the groove this is also provided with a nut designed as holder-on.

The invention is not limited to the shown embodiments but a number of variations are possible within the scope of claims. Thus it is possible to design the channel plate with another cross section shape than is shown, e.g. one which connects more closely to the outer shape of the discharge tube.

I claim:

1. A light sign comprising: a one-piece translucent illuminant plate having a front face, two pairs of opposite edges, the edges of each pair being parallel to each other and transverse to the edges of the other pair and a plurality of coplanar, parallel passages extending internally through the plate for receiving illuminating discharge tubes, the passages being open at both ends at one of the pairs of opposite edges of the illuminant plate; a translucent sign panel overlying and spaced outwardly from the front face of the illuminant plate, said panel having edges corresponding to the edges of the illuminant plate; and a frame assembly peripherally surrounding the illuminant plate and the sign panel, said frame assembly including two first frame members extending along one of the pairs of the opposite edges of the illuminant plate, each of said first frame members having spaced-apart flanges providing a channel in which the corresponding edge of the illuminant plate is located and each of said first frame members having a guide groove separate from the channel and extending along the length of the respective frame member, the corresponding edges of the sign panel being located in and slidable along the grooves, the frame assembly further including two second frame members extending along the other pair of opposite edges of the illuminant plate, each of said second frame members having spaced-apart flanges forming a channel in which the corresponding edge of the illuminant plate is located, said first and second pairs of frame members being connected end-to-end so as to support and retain the illuminant panel within the frame assembly, the second frame members being free of guide grooves for the sign panel, and the frame assembly further including profile members overlying and detachably connected to the second frame members, each profile member having a flange spaced from the respective second frame member and forming with the latter a groove for the respective edge of the sign panel, the arrangement being such that when a profile member has been detached from its respective second frame member the sign panel can be removed from the frame assembly by sliding the sign panel longitudinally out of the grooves in the first frame members and past one of the second frame members.

2. A light sign as in claim 1 wherein said profile members are made of slightly flexible plastic material.

3. A light sign as in claim 1 wherein each first frame member has T-shaped groove facing outwardly from the respective edge of the illuminant plate, for receiving connection members.

4. A light sign as in claim 3 wherein each second frame member has a T-shaped groove facing outwardly from the respective edge of the illuminant panel, for receiving connection members.

5. A light sign as in claim 4 wherein the profile members include connecting members attached thereto and complementary to the T-shaped grooves in the profile members.

6. A light sign as in claim 1 wherein the sign panel on its side facing the illuminant plate is provided with a translucent, reflecting coating and between said coating and the sign panel there is attachable the sign message.

7. A light sign as in claim 1 including discharge tubes in said passages, the tubes being provided with distance rings as guides in the passages.

8. A light sign as in claim 1 wherein the passage have a triangular cross section for fixing discharge tubes between two divergent walls of the passages.

9. A light sign as in claim 1 wherein adjacent passages in the illuminant plate are provided with at least single-sided reflectors.

10. A light sign as in claim 1 wherein the passages have a trapezoidal cross section for fixing discharge tubes between two divergent walls of the passages.

11. A light sign as in claim 1 wherein the panel on its side facing the illuminant plate is provided with an opaque disc and between said disc and the sign panel there is attachable the sign message.

* * * * *